US011167195B2

(12) United States Patent
Bridgewater

(10) Patent No.: US 11,167,195 B2
(45) Date of Patent: Nov. 9, 2021

(54) GOLF PUTTING TRAINING DEVICE

(71) Applicant: John Bridgewater, Fruit Cove, FL (US)

(72) Inventor: John Bridgewater, Fruit Cove, FL (US)

( * ) Notice: Subject to any disclaimer, the term of this patent is extended or adjusted under 35 U.S.C. 154(b) by 26 days.

(21) Appl. No.: 16/731,607

(22) Filed: Dec. 31, 2019

(65) Prior Publication Data

US 2021/0197060 A1 Jul. 1, 2021

(51) Int. Cl.
*A63B 69/36* (2006.01)

(52) U.S. Cl.
CPC ..... *A63B 69/3676* (2013.01); *A63B 69/3667* (2013.01); *A63B 2225/093* (2013.01)

(58) Field of Classification Search
CPC ..... A63B 69/3676; A63B 69/3667; A63B 2225/093
See application file for complete search history.

(56) References Cited

U.S. PATENT DOCUMENTS 3,787,048 A * 1/1974 Bock ..... A63B 21/00047 482/145
4,116,447 A * 9/1978 Becker ..... A63B 69/3676 473/276
4,659,084 A * 4/1987 Vuick ..... A63B 69/3621 473/264
4,900,030 A * 2/1990 Houtz ..... A63B 69/36211 473/258
4,919,433 A * 4/1990 Millat ..... A63B 69/36213 473/258
4,928,975 A * 5/1990 Skelley ..... A63B 69/3676 473/264
4,993,716 A * 2/1991 Waller ..... A63B 69/3608 473/275
4,998,731 A 3/1991 Bowen
5,769,732 A * 6/1998 O'Neal ..... A63B 69/36211 473/258
5,830,079 A 11/1998 Hudson
5,997,410 A * 12/1999 Nothdurft ..... A63B 69/3667 473/258
6,497,627 B2 12/2002 Collins
6,575,844 B1 * 6/2003 Gray ..... A63B 69/3667 473/277
6,755,751 B2 6/2004 Chapman
6,843,730 B1 * 1/2005 Bellagamba ..... A63B 69/3608 473/216
6,988,957 B2 * 1/2006 Bender ..... A63B 69/0059 473/266

(Continued)

*Primary Examiner* — Raleigh W Chiu

(57) ABSTRACT

A golf putting training device for improving a putting stroke of a user includes a base that is positionable on a surface. A pair of posts is coupled by lower ends to the base. Each post is positioned proximate to a respective opposed side of the base so that the posts define a reference plane that is perpendicular to the base. A guide unit is engaged to and extends from the base in a guide plane that is parallel to the reference plane guides a shaft of a putter during a putting stroke. A constriction unit that is engaged to the posts and selectively positionable in abutment to outer faces of knees of a user prevents outward motion of the knees during the putting stroke. A stance governing unit that is engaged to upper ends of the posts templates a posture of the user during the putting stroke.

13 Claims, 4 Drawing Sheets

(56) References Cited

U.S. PATENT DOCUMENTS 7,066,828 B2 * 6/2006 Lee ..... A63B 69/3608 473/266
7,083,527 B2 8/2006 Tai
7,217,198 B2 * 5/2007 Brooks ..... A63B 69/3621 473/260
D574,916 S 8/2008 Ford
7,758,443 B1 * 7/2010 Ford ..... A63B 69/3667 473/266
7,980,958 B1 * 7/2011 Ford ..... A63B 69/3623 473/266
8,029,380 B1 * 10/2011 Johansen ..... A63B 69/3676 473/257
8,152,650 B1 * 4/2012 Brandt ..... A63B 69/0057 473/266
2002/0111224 A1 * 8/2002 Sweinhart ..... A63B 69/3676 473/257
2003/0199330 A1 * 10/2003 Magallanes ..... A63B 69/3676 473/257
2003/0224868 A1 * 12/2003 Port ..... A63B 69/3676 473/261
2004/0204261 A1 * 10/2004 Port ..... A63B 69/36211 473/261
2005/0197199 A1 * 9/2005 Cardosi ..... A63B 69/3621 473/257
2005/0209015 A1 * 9/2005 Costa ..... A63B 69/3667 473/257
2008/0268976 A1 * 10/2008 Tischler ..... A63B 69/3621 473/219
2009/0118028 A1 * 5/2009 Tischler, II ..... A63B 69/36211 473/240
2010/0317450 A1 * 12/2010 Bowers ..... A63B 69/3667 473/257
2012/0172141 A1 * 7/2012 Vaughan ..... A63B 69/3673 473/266
2015/0165298 A1 * 6/2015 Williams ..... A63B 69/36211 473/218

* cited by examiner

GOLF PUTTING TRAINING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to golf training devices and more particularly pertains to a new golf training device for improving a putting stroke of a user.

(2) Description of Related Art Including Information Disclosed Under 37 CFR 1.97 and 1.98

The prior art relates to golf training devices. Prior art golf training devices intended to improve a putting stroke may comprise a frame that is used to guide or position at least one of a shaft of a putter, a user's head, knees, and shoulders, but which do not provide a curved surface that guides a path of the shaft of the putter or a means to prevent the knees of the user from moving outwardly during a putting stroke.

BRIEF SUMMARY OF THE INVENTION

An embodiment of the disclosure meets the needs presented above by generally comprising a base that is configured to be positioned on a surface. A pair of posts is coupled by lower ends to the base. Each post is positioned proximate to a respective opposed side of the base so that the pair of posts defines a reference plane that is perpendicular to the base. A guide unit engaged to and extends from the base in a guide plane that is parallel to the reference plane. The guide unit is configured to guide a shaft of a putter during a putting stroke. A constriction unit that is engaged to the posts is selectively positionable in abutment to outer faces of knees of a user. The constriction unit is configured to prevent outward motion of the knees during the putting stroke. A stance governing unit that is engaged to upper ends of the posts is configured to template a posture of the user during the putting stroke.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
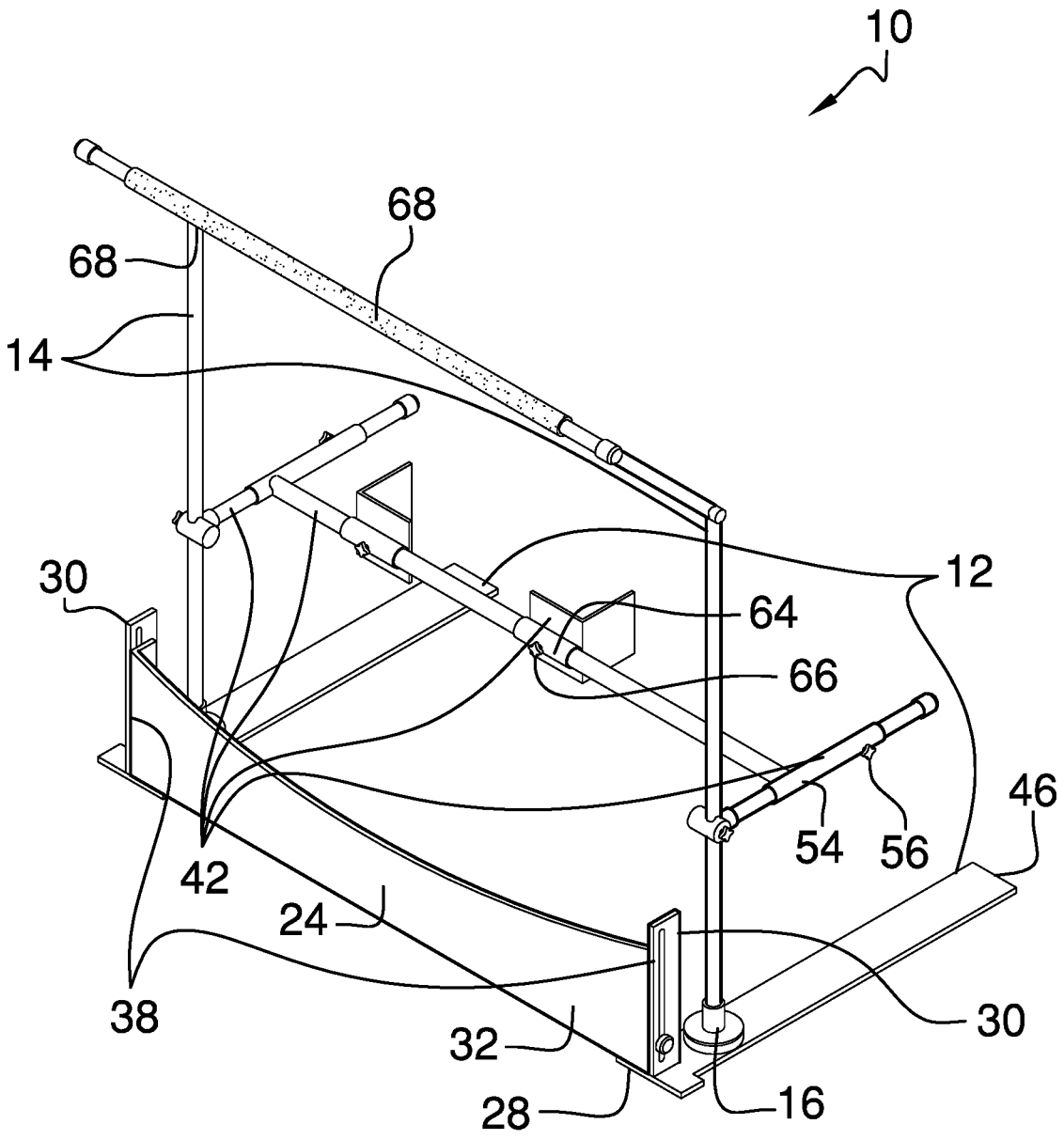
FIG. 1 is an isometric perspective view of a golf putting training device according to an embodiment of the disclosure.

With reference now to the drawings, and in particular to FIGS. 1 through 4 thereof, a new golf training device embodying the principles and concepts of an embodiment of the disclosure and generally designated by the reference numeral 10 will be described.

As best illustrated in FIGS. 1 through 4, the golf putting training device 10 generally comprises a base 12 that is configured to be positionable on a surface. A pair of posts 14 is coupled by lower ends 16 to the base 12 and extends perpendicularly therefrom. Each post 14 is positioned proximate to a respective opposed side 18 of the base 12 so that the pair of posts 14 defines a reference plane 20 that is perpendicular to the base 12. The base 12 comprises a pair of elongated plates 22. The elongated plates 22 of the pair of elongated plates 22 are parallel. The present invention anticipates each post 14 comprising a plurality of nested sections (not shown) so that the post 14 is selectively extensible.

A guide unit 24 that is engaged to and which extends from the base 12 in a guide plane 26 that is parallel to the reference plane 20 is configured to guide a shaft of a putter during a putting stroke. The guide unit 24 is positioned adjacent to a front 28 of the base 12 and the posts 14 are positioned proximate to the guide unit 24. The guide unit 24 is selectively extendable from the base 12 within the guide plane 26. As such, the guide unit 24 can be adjusted to accommodate users of various heights.

The guide unit 24 comprises a pair of endplates 30 and a guide plate 32. Each endplate 30 is coupled to and extends perpendicularly from a respective elongated plate 22. The endplate 30 has a slot 34 positioned longitudinally therethrough so that the slot 34 is perpendicular to the respective elongated plate 22. The guide plate 32 extends between the endplates 30 and is configured to be extended from the base 12 within the guide plane 26.

The guide plate 32 has an upper edge 36 that is concavely arcuate. As such the upper edge 36 of the guide plate 32 is configured to guide the shaft of the putter during the putting stroke. The guide plate 32 has opposed ends 38, each of which has a connector 40 engaged thereto. The connector 40 extends through a respective slot 34 and is configured to selectively engage the endplate 30 in which the respective slot 34 is positioned to fixedly position the guide plate 32 relative to the base 12.

Figure 2:
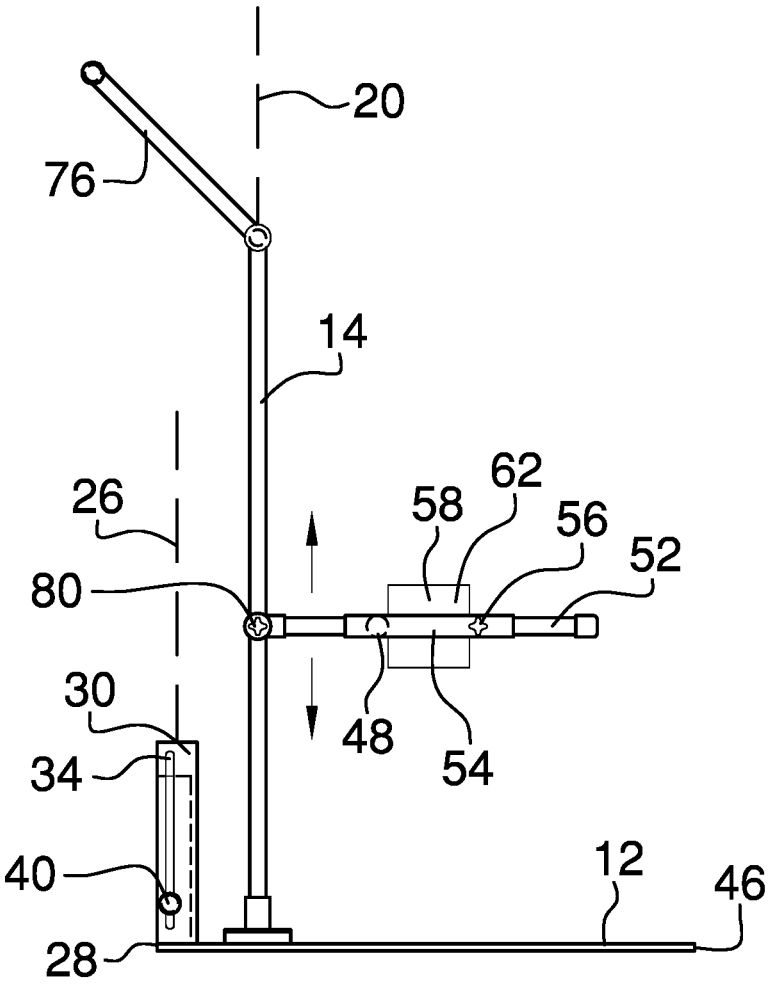
FIG. 2 is a side view of an embodiment of the disclosure.

A constriction unit 42 is engaged to the posts 14 so that the constriction unit 42 is selectively positionable in abutment to outer faces of knees of a user. The constriction unit 42 is configured to prevent outward motion of the knees during the putting stroke. The constriction unit 42 is selectively positionable on the posts 14 relative to the base 12 so that it can be selectively positioned at a height corresponding to the knees of the user, as shown in FIG. 2.

The constriction unit 42 comprises a frame 44 that is engaged to the posts 14 and which extends toward a rear 46 of the base 12. The frame 44 is parallel to the base 12 and is configured to slide on the posts 14. The frame 44 comprises a first rod 48 that has opposed termini 50. Each opposed terminus 50 has a second rod 52 engaged thereto and extending perpendicularly therefrom. The second rod 52 is engaged to an associated post 14 and extends toward the rear 46 of the frame 44 and parallel to the frame 44. The second rod 52 has a coupling 80 engage thereto and configured to engage the associated post 14 to fixedly position the constriction unit relative to the base 12.

The second rod 52 has a slider tube 54 positioned and slidable thereupon. The first rod 48 is coupled to and extends between the slider tubes 54. The slider tube 54 has a fastener 56 engaged thereto and configured to selectively engage the second rod 52 to fixedly position the first rod 48 relative to the reference plane 20.

Figure 3:
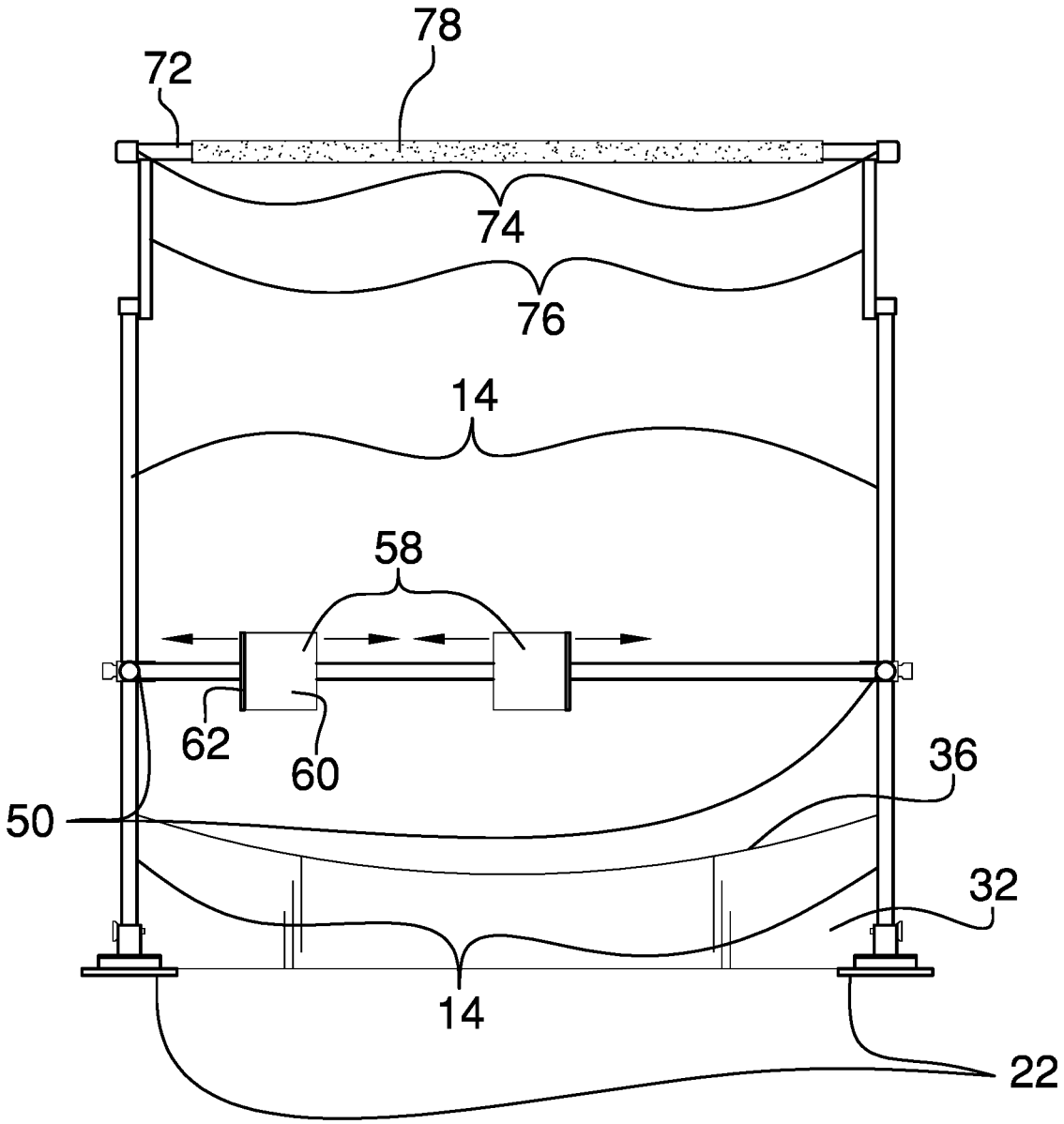
FIG. 3 is a back view of an embodiment of the disclosure.
Figure 4:
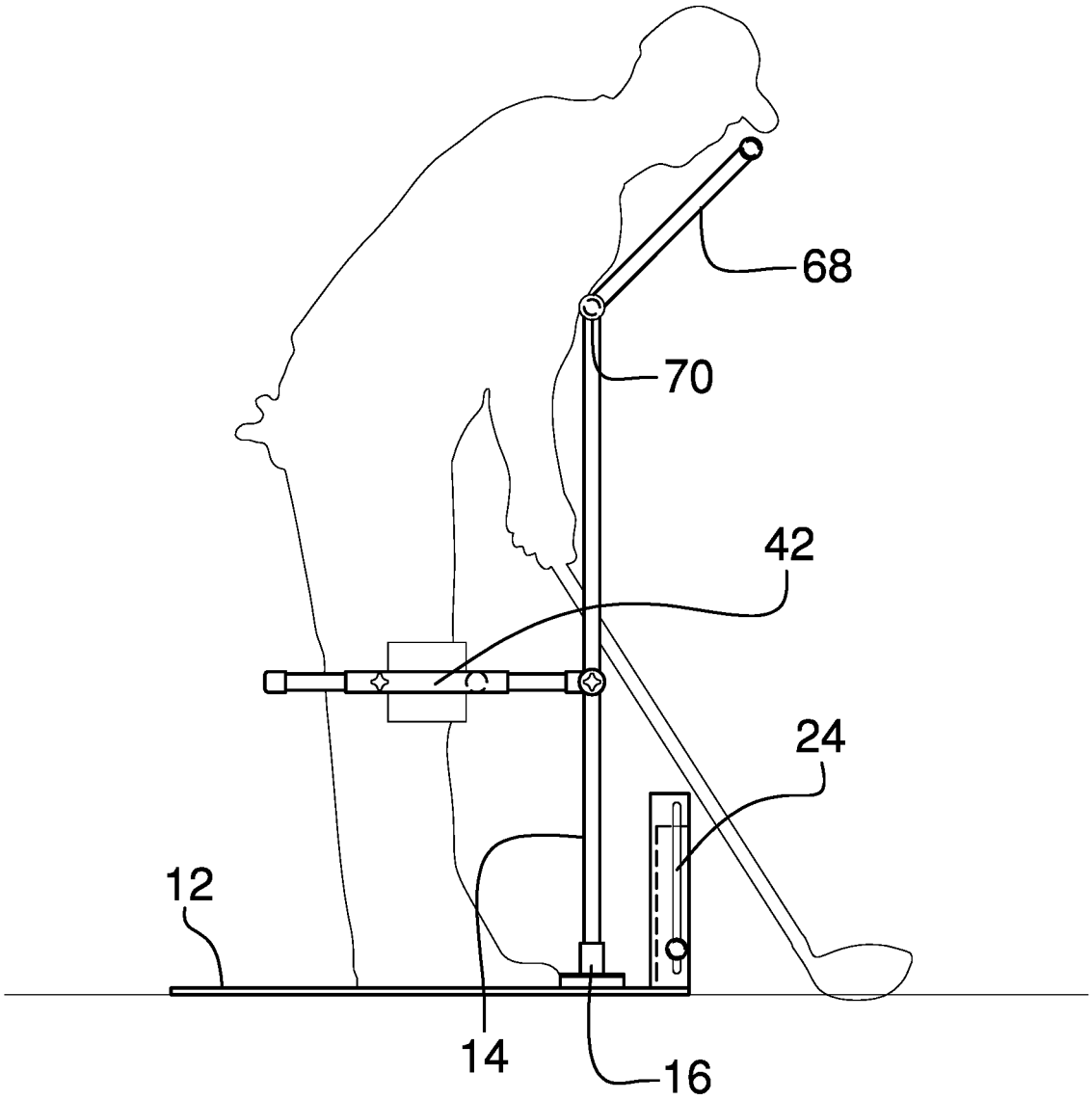
FIG. 4 is an in-use view of an embodiment of the disclosure.

A pair of brackets 58 that is engaged to the frame 44 and is configured to be slid on the frame 44 relative to the posts 14, as shown in FIG. 3. Each bracket 58 is positionable in abutment to the outer face of an associated knee of the user with the knees of the user being separated at a distance that is required for a proper putting stance. The bracket 58 comprises a first section 60 that is coupled to and which extends perpendicularly from a second section 62 so that the bracket 58 is L-shaped. The first section 60 has a slidable tube 64 coupled thereto with the first rod 48 being positioned therethrough so that the first section 60 is parallel planarly positioned relative to the reference plane 20. The slidable tube 64 has a coupler 66 engaged thereto that is configured to selectively engage the first rod 48 to fixedly position the bracket 58 on the first rod 48.

A stance governing unit 68 that is engaged to upper ends 70 of the posts 14 is configured to template a posture of the user during the putting stroke. The stance governing unit 68 comprises a first tube 72 that has opposed endpoints 74. Each opposed endpoint 74 has a second tube 76 coupled thereto and extending therefrom. The second tube 76 is engaged to an upper end 70 of an associated post 14 so that the second tube 76 is transverse to the reference plane 20 and so that the first tube 72 is parallel to and positioned past the guide plane 26.

The first tube 72 has a pad 78 engaged thereto. The present invention also anticipates the second tube 76 being pivotally engaged to the upper end 70 of the associated post 14 so that the stance governing unit 68 is selectively pivotable relative to the reference plane 20.

In use, the base 12 is positioned on the surface, such as a practice green. The constriction unit 42 is adjusted to a height to match that of the knees of the user and the brackets 58 are positioned in abutment to the knees to prevent their outward motion during the putting stroke. The user bends at their waist, positioning their forehead proximate to or on the first tube 72 to enter the posture required for putting. The guide plate 32 is extended from the base 12 to a height required for the user. The upper edge 36 of the guide plate 32 guides the shaft of the putter during practicing of the putting stroke. Repeated practicing of the putting stroke with the device 10 instils muscle memory, allowing the user to assume proper posture and to execute a proper putting stroke without use of the device 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A golf putting training device comprising:

a base configured to be positionable on a surface, the base having a pair of posts coupled by lower ends thereto, each post being positioned proximate to a respective opposed side of the base so that the pair of posts defines a reference plane perpendicular to the base;

a guide unit engaged to and extending from the base in a guide plane parallel to the reference plane and being configured to guide a shaft of a putter during a putting stroke, the guide unit being selectively extendable from the base within the guide plane;

a constriction unit engaged to the posts such that the constriction unit is selectively positionable in abutment to outer faces of knees of a user wherein the constriction unit is configured to prevent outward motion of the knees during the putting stroke, the constriction unit being selectively positionable on the posts relative to the base; and a stance governing unit engaged to upper ends of the posts and being configured to template a posture of the user during the putting stroke.

2. The golf putting training device of claim 1, wherein:

the guide unit is positioned adjacent to a front of the base; and the posts are positioned proximate to the guide unit.

3. The golf putting training device of claim 1, wherein the base comprises a pair of elongated plates, the elongated plates of the pair of elongated plates being parallel.

4. The golf putting training device of claim 1, wherein:

the stance governing unit comprises a first tube having opposed endpoints; and each opposed endpoint having a second tube coupled thereto and extending therefrom, the second tube being engaged to an upper end of an associated post, such that the second tube is transverse to the reference plane, and such that the first tube is parallel to and positioned past the guide plane.

5. The golf putting training device of claim 4, wherein the first tube has a pad engaged thereto.

6. The golf putting training device of claim 1, further comprising:

the pair of posts extending perpendicularly from the base, the base comprising a pair of elongated plates, the elongated plates of the pair of elongated plates being parallel;

the guide unit being positioned adjacent to a front of the base, the posts being positioned proximate to the guide unit, the guide unit comprising:

a pair of endplates, each endplate being coupled to and extending perpendicularly from a respective elongated plate, the endplate having a slot positioned longitudinally therethrough such that the slot is perpendicular to the respective elongated plate, and a guide plate extending between the endplates and being configured to extend from the base within the guide plane, the guide plate having an upper edge, the upper edge being concavely arcuate, the guide plate having opposed ends, each opposed end having a connector engaged thereto, extending through a respective slot, and configured to selectively engage the endplate in which the respective slot is positioned to fixedly position the guide plate relative to the base; the constriction unit comprising:

a frame engaged to the posts and extending toward a rear of the base, the frame being parallel to the base and configured to slide on the posts, the frame comprising a first rod having opposed termini, each opposed terminus having a second rod engaged thereto and extending perpendicularly therefrom, the second rod being engaged to an associated post and extending toward the rear of and parallel to the frame, the second rod having a coupling engaged thereto and being configured to selectively engage the associated post to fixedly position the constriction unit relative to the base, the second rod having a slider tube positioned and slidable thereupon, the first rod being coupled to and extending between the slider tubes, the slider tube having a fastener engaged thereto and configured to selectively engage the second rod to fixedly position the first rod relative to the reference plane, and a pair of brackets engaged to the frame and being configured to slide on the frame relative to the posts such that each bracket is positionable in abutment to the outer face of an associated knee of the user with the knees of the user separated at a distance required for a proper putting stance, the bracket comprising a first section coupled to and extending perpendicularly from a second section so that the bracket is L-shaped, the first section having a slidable tube coupled thereto with the first rod being positioned therethrough such that the first section is parallel planarly positioned relative to the reference plane, the slidable tube having a coupler engaged thereto and being configured to selectively engage the first rod to fixedly position the bracket on the first rod; and the stance governing unit comprising a first tube having opposed endpoints, each opposed endpoint having a second tube coupled thereto and extending therefrom, the second tube being engaged to an upper end of an associated post such that the second tube is transverse to the reference plane and such that the first tube is parallel to and positioned past the guide plane, the first tube having a pad engaged thereto.

7. A golf putting training device comprising:

a base configured to be positionable on a surface, the base having a pair of posts coupled by lower ends thereto, each post being positioned proximate to a respective opposed side of the base so that the pair of posts defines a reference plane perpendicular to the base;

a guide unit engaged to and extending from the base in a guide plane parallel to the reference plane and being configured to guide a shaft of a putter during a putting stroke;

a constriction unit engaged to the posts such that the constriction unit is selectively positionable in abutment to outer faces of knees of a user wherein the constriction unit is configured to prevent outward motion of the knees during the putting stroke;

a stance governing unit engaged to upper ends of the posts and being configured to template a posture of the user during the putting stroke; and wherein the guide unit comprises:

a pair of endplates, each endplate being coupled to and extending perpendicularly from a respective elongated plate; and a guide plate extending between the endplates and being configured to extend from the base within the guide plane, the guide plate having an upper edge, the upper edge being concavely arcuate.

8. The golf putting training device of claim 7, wherein:

the endplate has a slot positioned longitudinally therethrough such that the slot is perpendicular to the respective elongated plate; and the guide plate has opposed ends, each opposed end having a connector engaged thereto, extending through a respective slot, and configured to selectively engage the endplate in which the respective slot is positioned to fixedly position the guide plate relative to the base.

9. A golf putting training device comprising:

a base configured to be positionable on a surface, the base having a pair of posts coupled by lower ends thereto, each post being positioned proximate to a respective opposed side of the base so that the pair of posts defines a reference plane perpendicular to the base;

a guide unit engaged to and extending from the base in a guide plane parallel to the reference plane and being configured to guide a shaft of a putter during a putting stroke;

a constriction unit engaged to the posts such that the constriction unit is selectively positionable in abutment to outer faces of knees of a user wherein the constriction unit is configured to prevent outward motion of the knees during the putting stroke;

a stance governing unit engaged to upper ends of the posts and being configured to template a posture of the user during the putting stroke; and wherein the constriction unit comprises:

a frame engaged to the posts and extending toward a rear of the base, the frame being parallel to the base and configured to slide on the posts; and a pair of brackets engaged to the frame and being configured to slide on the frame relative to the posts such that each bracket is positionable in abutment to the outer face of an associated knee of the user with the knees of the user separated at a distance required for a proper putting stance.

10. The golf putting training device of claim 9, wherein the frame comprises a first rod having opposed termini, each opposed terminus having a second rod engaged thereto and extending perpendicularly therefrom, the second rod being engaged to an associated post and extending toward the rear of and parallel to the frame.

11. The golf putting training device of claim 10, wherein the second rod having a coupling engaged thereto and being configured to selectively engage the associated post to fixedly position the constriction unit relative to the base.

12. The golf putting training device of claim 10, further including:

the bracket comprising a first section coupled to and extending perpendicularly from a second section so that the bracket is L-shaped;

the first section having a slidable tube coupled thereto with the first rod being positioned therethrough such that the first section is parallel planarly positioned relative to the reference plane; and the slidable tube having a coupler engaged thereto and being configured to selectively engage the first rod to fixedly position the bracket on the first rod.

13. The golf putting training device of claim 10, wherein:

the second rod has a slider tube positioned and slidable thereupon, the first rod being coupled to and extending between the slider tubes; and the slider tube having a fastener engaged thereto and configured to selectively engage the second rod to fixedly position the first rod relative to the reference plane.

* * * * *